US009011048B2

(12) United States Patent
Hilfiker et al.

(10) Patent No.: US 9,011,048 B2
(45) Date of Patent: Apr. 21, 2015

(54) METHOD FOR CONSTRUCTING A MECHANICALLY STABILIZED EARTHEN EMBANKMENT USING SEMI-EXTENSIBLE STEEL SOIL REINFORCEMENTS

(71) Applicants: William K. Hilfiker, Eureka, CA (US); William Brent Hilfiker, Fortuna, CA (US); Harold K. Hilfiker, Eureka, CA (US)

(72) Inventors: William K. Hilfiker, Eureka, CA (US); William Brent Hilfiker, Fortuna, CA (US); Harold K. Hilfiker, Eureka, CA (US)

( * ) Notice: Subject to any disclaimer, the term of this patent is extended or adjusted under 35 U.S.C. 154(b) by 0 days.

(21) Appl. No.: 14/107,548

(22) Filed: Dec. 16, 2013

(65) Prior Publication Data

US 2014/0105693 A1 Apr. 17, 2014

Related U.S. Application Data

(63) Continuation-in-part of application No. 12/819,893, filed on Jun. 21, 2010, now abandoned, which is a continuation-in-part of application No. 12/467,158, filed on May 15, 2009, now abandoned.

(60) Provisional application No. 61/054,012, filed on May 16, 2008.

(51) Int. Cl.

| | |
|---|---|
| ***E02D 29/02*** | (2006.01) |
| ***E02D 17/20*** | (2006.01) |
| ***E02D 17/18*** | (2006.01) |

(52) U.S. Cl.

CPC ..... *E02D 17/20* (2013.01); *E02D 17/18* (2013.01)

(58) Field of Classification Search

USPC ..... 405/262, 284–287, 302.4, 302.6, 302.7

See application file for complete search history.

(56) References Cited

U.S. PATENT DOCUMENTS

| | | | |
|---|---|---|---|
| 1,762,343 | A | 6/1930 | Munster |
| 3,922,864 | A | 12/1975 | Hilfiker |
| 4,343,572 | A | 8/1982 | Hilfiker |
| 4,407,611 | A | 10/1983 | Murray et al. |
| 4,798,499 | A | 1/1989 | Yamada |
| 4,834,584 | A | 5/1989 | Hilfiker |
| 4,929,125 | A | 5/1990 | Hilfiker |
| 4,993,879 | A | 2/1991 | Hilfiker |
| 5,044,833 | A | 9/1991 | Wilfiker |
| 6,086,288 | A | 7/2000 | Ruel et al. |
| 6,371,699 | B1 | 4/2002 | Weinreb |
| 6,517,293 | B2 | 2/2003 | Taylor et al. |
| 7,073,983 | B2 | 7/2006 | Hilfiker |
| 7,270,502 | B2 | 9/2007 | Brown |
| 2007/0014638 | A1 | 1/2007 | Brown |

FOREIGN PATENT DOCUMENTS

| | | |
|---|---|---|
| JP | 61242225 A | 10/1986 |
| JP | 63284321 | 11/1988 |

*Primary Examiner* — Sunil Singh

(74) *Attorney, Agent, or Firm* — Eric Karich; Karich & Associates

(57) ABSTRACT

A method for constructing a mechanically stabilized earthen embankment has the steps of constructing a wall facing element, and determining a plane of maximum force and a zone of maximum force in the earthen embankment to be formed. A plurality of elongate soil reinforcement elements are bent to form semi-extensible bent segments, but such that proximal and distal portions remain substantially straight and inextensible. The elongate soil reinforcement elements are positioned such that the semi-extensible region is within the zone of maximum force, and the proximal ends are connected to the wall facing element. Fill soil is added to build the earthen embankment, and the process is repeated until the earthen embankment is formed.

9 Claims, 12 Drawing Sheets

METHOD FOR CONSTRUCTING A MECHANICALLY STABILIZED EARTHEN EMBANKMENT USING SEMI-EXTENSIBLE STEEL SOIL REINFORCEMENTS

CROSS-REFERENCE TO RELATED APPLICATIONS

This application for a utility patent is a further continuation-in-part of previously filed patent Ser. No. 12/819,893, filed Jun. 21, 2010, which was a continuation-in-part of a previously filed utility patent, now abandoned, having the application Ser. No. 12/467,158, filed May 15, 2009. This application also claims the benefit of U.S. Provisional Application No. 61/054,012, filed May 16, 2008.

BACKGROUND OF THE INVENTION

1. Field of the Invention

This invention relates generally to mechanically stabilized embankment systems, and more particularly to a method for constructing a mechanically stabilized earthen embankment using semi-extensible steel soil reinforcements.

2. Description of Related Art

The prior art teaches various forms of mechanically stabilized embankment systems for stabilizing earthen embankments. These systems include a wall facing element connected to elongate soil reinforcement elements that extend into the earthen embankment. The prior art elongate soil reinforcement elements fall into three categories: (1) extensible reinforcements made of plastic or other material that stretch under pressure, (2) non-extensible rods made of steel or the like that have a deformable region in a proximal portion of the rod adjacent the wall facing element, to accommodate some relative movement between the rods and the wall facing element (e.g., in the event of an earthquake), and (3) non-extensible rods that are bent in various manners for the purpose of anchoring the rod in the earthen embankment.

In the first category, extensible plastic reinforcements are effective in accommodating movement of the earthen embankment along the entire length of the plastic reinforcements. The disadvantage of such systems is that the reinforcements are completely extensible, and there is nothing to limit the stretching of the reinforcements. Stretching the reinforcements weakens them and may cause movement of the face and failure of the system.

In the second category, non-extensible steel rods with deformable sections adjacent the wall facing element are useful in mitigating damage from earthquakes and some movement of the rods immediately adjacent the wall facing element, while still maintain support for the wall facing. Munster, U.S. Pat. No. 1,762,343, for example, teaches a system wherein the anchor elements are slidably attached to the retaining wall. Hilfiker, U.S. Pat. No. 4,343,572, teaches a system wherein the anchor elements include deformable sections adjacent the wall facing, so that the anchor element may move with the embankment in the event of an earthquake or other form of movement adjacent the wall facing. While the steel rods of this second category function to deform under the stresses adjacent the wall, they are not able to accommodate stresses placed upon the rods inside the earthen embankment. Since the rods are not extensible within the earthen embankment, they must be made with sufficiently steel to prevent failure within the earthen embankment, this driving up the costs of the system.

There are several prior art references that teach steel rods, straps, and the like, that include bent portions to provide limited extensibility. Most pertinent of these references, Brown, U.S. Pat. No. 7,270,502, teaches steel reinforcing straps (or rods) that are corrugated, having bent sections along the entire length of the straps. The corrugated structure of the straps is intended to provide pull out resistance, and also semi-extensibility; however, it is difficult to limit the extensibility of the straps, since the entire length of the strap is subject to being pulled straight. Sufficient force exerted on the straps tends to cause too much extension, which can lead to failure of the wall facing. Furthermore, as the bent segments are straightened under the stress, the straps lose pull out resistance, further compounding the problem.

Other references teach steel reinforcement rods having a bent "swiggle" anchor at the distal portion opposite the wall. The "swiggle" anchor functions to anchor the rods more firmly in the earthen embankment. An example of such a construction is shown in Hilfiker, U.S. Pat. No. 4,834,584. However, this form of "swiggle" anchor is unable to accommodate movement within the earthen structure.

Other prior art patents of interest include Hilfiker, U.S. Pat. No. 7,073,983, Hilfiker, U.S. Pat. No. 4,929,125, Hilfiker, U.S. Pat. No. 4,993,879. All of the above-described references are hereby incorporated by reference in full.

The prior art teaches extensible plastic reinforcements. The prior art also teaches the use of non-extensible steel rods that include deformable, bent portions, at either the proximal or distal portions, or along the entire length of the rods. However, the prior art does not teach elongate soil reinforcement elements that only include having bent sections at the location of maximum force. Such "semi-extensible" elements enable limited movement within the earthen embankment adjacent the location of maximum force, as described below, without weakening the elongate soil reinforcement elements and without providing too much extension that could lead to the failure of the wall facing. The present invention fulfills these needs and provides further related advantages as described in the following summary.

SUMMARY OF THE INVENTION

The present invention teaches certain benefits in construction and use which give rise to the objectives described below.

The present invention provides a method for constructing a mechanically stabilized earthen embankment has the steps of constructing a wall facing element, and determining a plane of maximum force and a zone of maximum force in the earthen embankment to be formed. A plurality of elongate soil reinforcement elements are bent to form semi-extensible bent segments, but such that proximal and distal portions remain substantially straight and inextensible. The elongate soil reinforcement elements are positioned such that the semi-extensible region is within the zone of maximum force, and the proximal ends are connected to the wall facing element. Fill soil is added to build the earthen embankment, and the process is repeated until the earthen embankment is formed.

A primary objective of the present invention is to provide a method for constructing a mechanically stabilized embankment system having advantages not taught by the prior art.

Another objective is to provide a method for constructing a mechanically stabilized embankment system that includes an elongate soil reinforcement element having a plurality of semi-extensible bent segments formed in a middle portion of the elongate soil reinforcement element, where maximum force occurs, but which are substantially straight and inextensible at proximal and distal ends, to prevent excessive extensibility.

Another objective is to provide a method for constructing a mechanically stabilized embankment system that includes a elongate soil reinforcement element that is semi-extensible and may extend a certain distance to accommodate a controlled movement within the earthen structure, but then becomes non-extensible and is not weakened by over-extension.

A further objective is to provide a method for constructing a mechanically stabilized embankment system that allows sufficient movement within an earthen structure so that it may move to the "active" condition, thereby stabilizing the earthen structure and reducing the strain on the elongate soil reinforcement elements.

A further objective is to provide a method of construction that enables the use of lower strength soil reinforcement elements, thereby reducing costs without sacrificing the integrity of the earthen structure.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention. In such drawings.

DETAILED DESCRIPTION OF THE INVENTION

Figure 1:
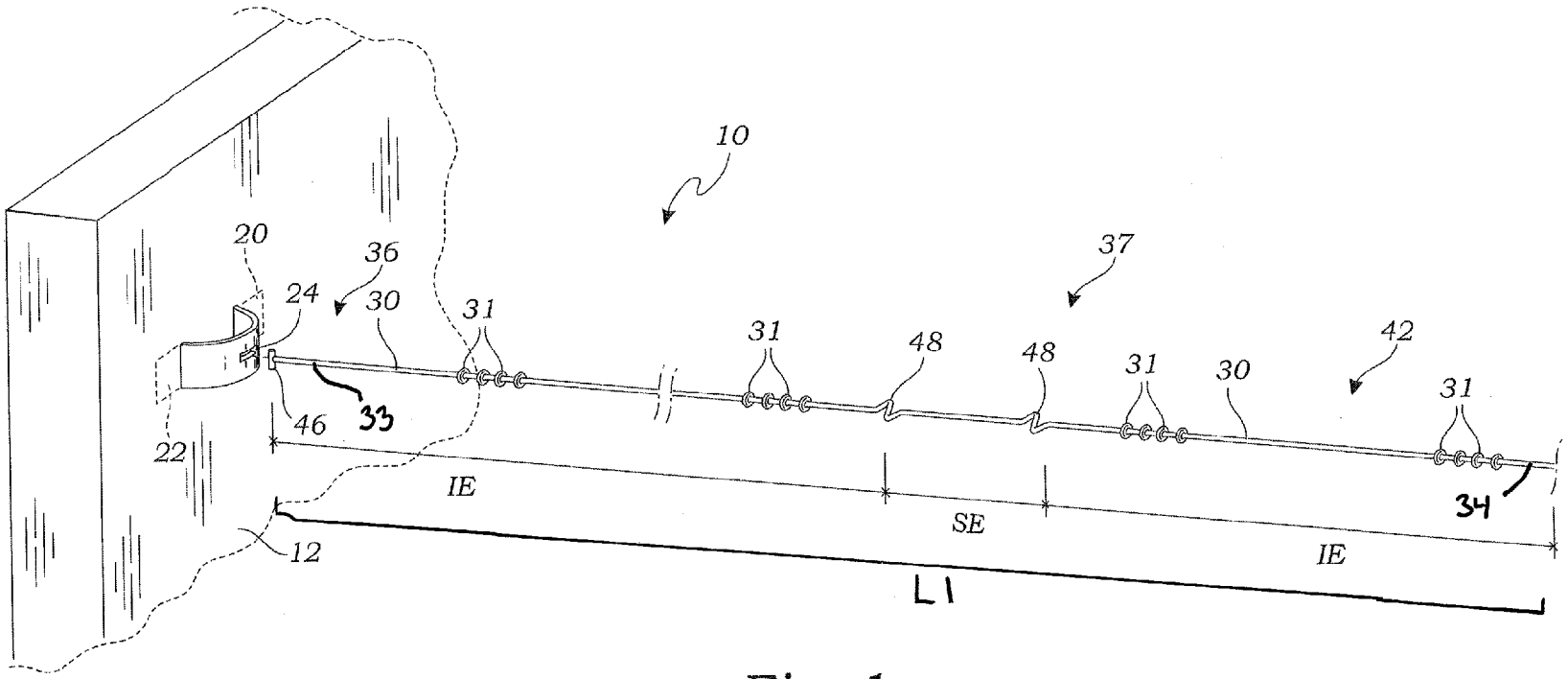
FIG. 1 is an exploded perspective view of a one embodiment of a mechanically stabilized embankment system, illustrating an elongate soil reinforcement element having a plurality of semi-extensible bent segments, a plurality of ribs spaced along the length of the elongate soil reinforcement element, and a connection element for attaching the elongate soil reinforcement element to a wall facing element.

The above-described drawing figures illustrate the invention, a method for constructing a mechanically stabilized embankment system 10. The mechanically stabilized embankment system 10 includes an elongate soil reinforcement element 30 having a plurality of semi-extensible bent segments 48. The system 10 may further include a means for securing the elongate soil reinforcement element 30 to a wall facing element 12, such as a connection element 20 for connecting the soil reinforcement element 30 to the wall facing element 12.

The elongate soil reinforcement element 30 includes a proximal end 33, a distal end 34, a length, L1, a proximal portion 36, a middle portion 37, and a distal portion 42. The semi-extensible bent segments 48 of the middle portion 37 enable the middle portion 37, which is subjected to the maximum stresses, to extend a limited amount under strain. This limited "semi-extensible" movement allows the backfill soil of the earthen embankment 15 to go into the active condition, thereby reducing the strain on the elongate soil reinforcement elements 30, without weakening the final strength of the soil reinforcement element 30. Furthermore, the proximal portion 36 and distal portion 42 are straight, do not include the semi-extensible bent segments 48, and are therefore inextensible. Since most of the elongate soil reinforcement elements 30 are inextensible, the elongate soil reinforcement elements 30 do not lengthen enough under strain to allow the wall facing element 12 to move or fail. Also, the proximal portion 36 of the elongate soil reinforcement element 30 extends at least 0.9144 meters (3.0 feet) from the proximal end 33 of the elongate soil reinforcement element 30 and the distal portion 42 of the elongate soil reinforcement element 30 extends at least 0.9144 meters (3.0 feet) from the distal end 34 of the elongate soil reinforcement element 30. The length L1 of the elongate soil reinforcement element 30 may be determined by one skilled in the art, and vary according the application.

Each of the elongate soil reinforcement elements 30 may have two or more of the semi-extensible bent segments 48, the semi-extensible bent segments 48 forming a semi-extensible region SE, but wherein the proximal portion 36 of the elongate soil reinforcing elements 30 adjacent the proximal end 33, and the distal portion 42 adjacent the distal end 34, remain substantially straight and inextensible. The semi-extensible region SE is defined as being the region bounded by the outermost endpoints of the semi-extensible bent segments 48 as taken along the elongate soil reinforcement element 30.

Figure 2:
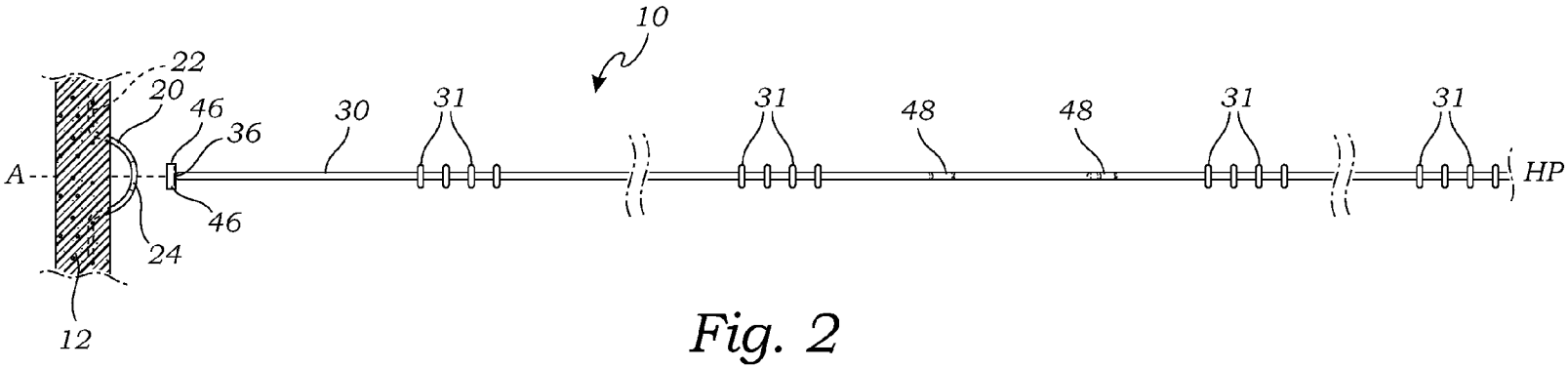
FIG. 2 is a top plan view thereof, illustrating the elongate soil reinforcement element once it has been rotated 90° for insertion into the connection element.
Figure 3:
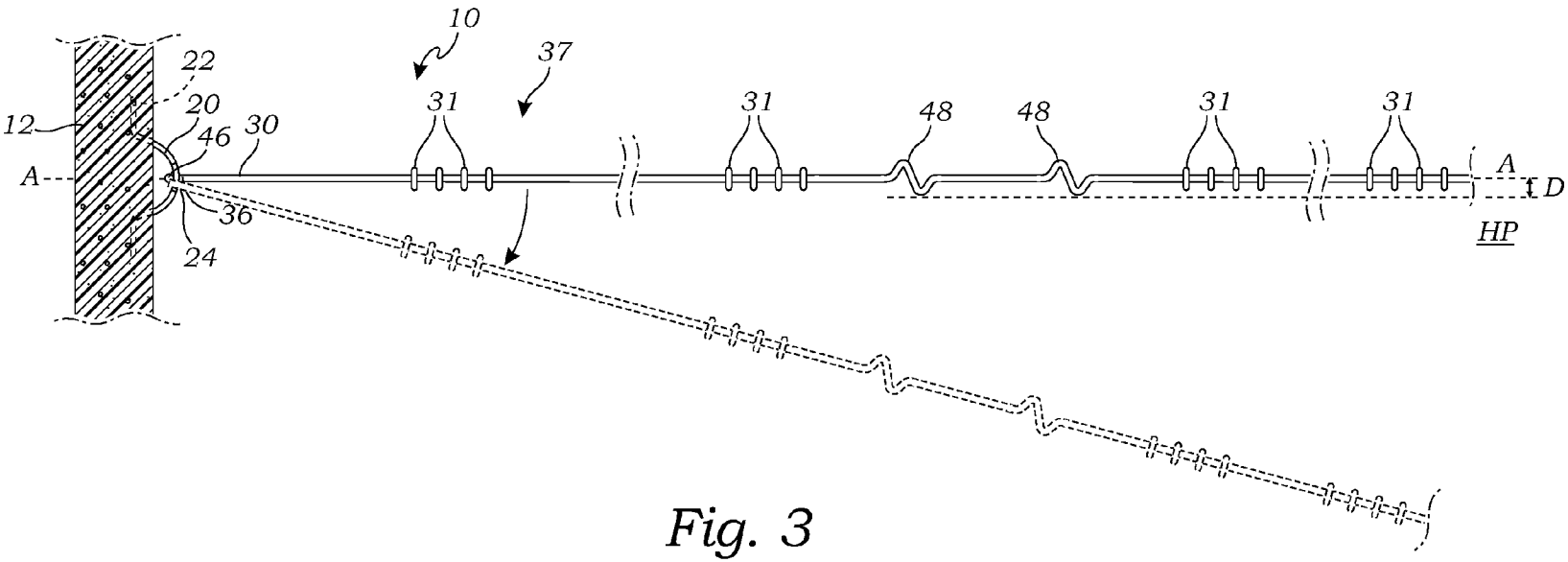
FIG. 3 is a top plan view thereof once the elongate soil reinforcement element has been inserted into the connection element and rotated back ninety degrees to a locked position.

FIG. 1 is an exploded perspective view of one embodiment of the mechanically stabilized embankment system 10, illustrating a rod form of the elongate soil reinforcement element 30, including ribs 31 described in greater detail below. FIG. 2 is a top plan view thereof, illustrating the elongate soil reinforcement element 30 once it has been rotated 90° for insertion into a connection element 20. FIG. 3 is a top plan view thereof once the elongate soil reinforcement element 30 has been inserted into the connection element 20 and rotated back ninety degrees to a locked position.

As illustrated in FIGS. 1-3, in a first embodiment the connection element 20 is a connection bracket. In this embodiment, the connection bracket 20 may include a wall engaging element 22 and a first interlocking element 24. The wall engaging element 22 is adapted for engaging the wall facing element 12. In the embodiment of FIGS. 1-3, the connection bracket 20 has a generally U-shaped cross-section, and the wall engaging element 22 is provided by outwardly extending flanges. In this embodiment, the wall facing element 12 is made of concrete, and when the concrete is poured, the connection bracket 20 is positioned such that the outwardly extending flanges 22 are locked within the setting concrete, using techniques well-known in the art.

The first interlocking element 24 is adapted for receiving and lockingly engaging the soil reinforcement element 30. In the embodiment of FIGS. 1-3, the first interlocking element 24 is a rectangular slot adapted to receive the soil reinforcement element 30, as described in greater detail below. Alternative interlocking elements may be devised by those skilled in the art, and should be considered within the scope of the present invention.

In the embodiment of FIGS. 1-3, the elongate soil reinforcement element 30 is an elongate rod, and the semi-extensible bent segments 48 may be a deformable kinked section that are integrally formed by the elongate soil reinforcement element 30 and placed along the length of, or portion of, the middle portion 37 of the elongate soil reinforcement element 30, to extend laterally a distance D from the axis A (as illustrated in FIG. 3) of the element 30.

In one embodiment, the elongate soil reinforcement element 30 is made of a "non-extensible" material such as steel, aluminum, or other suitable material, such as is known to those skilled in the art (see American Association of State Highway and Transportation Officials (AASHTO) guidelines and standards). "Semi-extensible" elements are constructed of non-extensible materials but are physically bent to provide a measure of extensibility despite the non-extensible nature of the underlying material. These materials are used in preference to "extensible" materials such as plastics, which suffer disadvantages described above.

In one embodiment, the semi-extensible bent segments 48 may be generally V-shaped or Z-shaped elements. In alternative embodiments, some of which are discussed below, the semi-extensible bent segments 48 may have other shapes (e.g., C-shaped, or any other shape that provides for semi-extensibility), and may be formed in any suitable number and position as may be selected by one skilled in the art. The semi-extensible bent segments 48 are integrally formed by and spaced on the middle portion 37 of the elongate soil reinforcement element 30 such that each semi-extensible bent segments 48 extend laterally from the axis A, but can be pulled straight upon the application of excessive force that might otherwise break the elongate soil reinforcement element 30.

For purposes of this application, the term "soil reinforcement element" is hereby defined to include any form of elongate rod, strap, screw, bar, shaft, mesh, grid, and/or other similar and/or equivalent structure. The reinforcement element 30 may have an axis, which is hereby defined to include any form of general line adapted to bear the strain of supporting the wall facing element 12 against the weight of the earthen embankment.

The proximal portion 36 of the elongate soil reinforcement element 30 includes a second interlocking element 46 adapted to lockingly engage the first interlocking element 24 of the connection bracket 20. In the present embodiment, a second interlocking element 46 includes a pair of outwardly extending posts that are generally perpendicular to the axis A of the elongate soil reinforcement element 30. The posts 46 may be inserted into the rectangular slot 24, as illustrated in FIG. 2, and when the elongate soil reinforcement element 30 is rotated 90°, as illustrated in FIG. 3, the posts 46 lockingly engage the connection bracket 20.

While some additional embodiments of the first and second interlocking elements 24 and 46 are discussed in greater detail below, any form of interlocking known in the art, or devisable by one skilled in the art consistent with the present invention, should be considered within the scope of the present invention.

As discussed above, the semi-extensible bent segments 48 enable the soil reinforcement element 30 to not only provide pull-out resistance, but to also withstand greater strains and/or deformations within the earthen embankment without breaking. When the earthen embankment exerts a strain against the elongate soil reinforcement element 30, or when the earthen embankment deforms the elongate soil reinforcement element 30 in other ways (e.g., shifting soil, or other conditions), the semi-extensible bent segments 48 enable the element 30 to extend somewhat before breaking. Obviously, those skilled in the art may devise many alternative shapes and embodiments of the semi-extensible bent segments 48 (some of which are discussed in greater detail below), and such alternatives should be considered within the scope of the claimed invention. The distal portion 42 is typically without any form of anchor or similar feature.

As illustrated in FIG. 1, the elongate soil reinforcement element 30 includes a plurality of ribs 31 spaced along substantially the entire length of the elongate soil reinforcement element 30. The ribs 31 illustrate a first embodiment of pull-out resistance elements. In another example, illustrated in FIG. 7, the pull-out resistance elements are ridges 59. In another example, illustrated in FIG. 8, the pull-out resistance elements are lateral elements 66. These are discussed in greater detail below.

As illustrated in FIG. 1, the ribs 31 extend laterally from the elongate soil reinforcement element 30, and function to increase the pullout resistance of the elongate soil reinforcement element 30. The ribs 31 may be formed in many manners known to those skilled in the art (e.g., welding or otherwise attaching washer-like elements, fabricating integral deformations in a manner similar to rebar, etc.). In one embodiment, the ribs 31 are about 0.00635 m (¼ inch) high and spaced about 0.0508 m (2 inches) apart; however, those skilled in the art may devise alternative sizes, arrangements, and spacing, and such alternatives should be included within the scope of the present invention. For purposes of this application, the term "substantially the entire length" shall include any arrangement and spacing that function to provide suitable pull-out resistance along effectively the entire length of the element 30, notwithstanding the provision of gaps in coverage that would be deemed functionally equivalent to one skilled in the art.

Also illustrated in FIGS. 2-3, the semi-extensible bent segments 48 are preferably disposed on a horizontal plane HP when installed, as discussed in greater detail below. The disposition on the horizontal plane HP facilitates installation of the elements 30 by stabilizing them; and furthermore, this disposition protects the semi-extensible bent segments 48 from damage during the compacting of the fill, also discussed in greater detail below.

Figure 4:
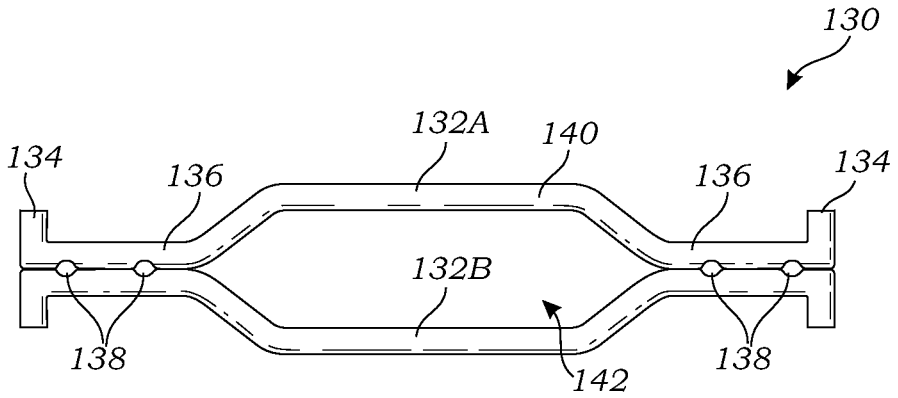
FIG. 4 is a front elevation view of an alternative embodiment of the connection element of FIGS. 1-3.
Figure 5:
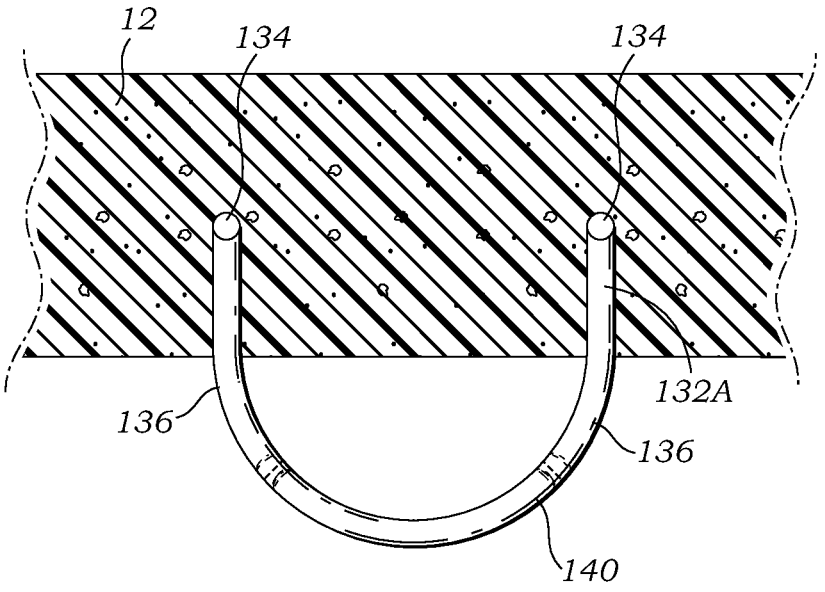
FIG. 5 is a top plan view thereof once the connection element has been bent into a generally C-shape.

FIG. 4 is a front elevation view of an alternative embodiment of the connection bracket 130 of FIGS. 1-3. FIG. 5 is a top plan view thereof once the connection bracket 130 has been bent into a generally C-shape. As illustrated in FIGS. 4 and 5, in the alternative embodiment of the connection bracket 130, the connection bracket 130 includes a top wire element 132A and a bottom wire element 132B, which may be mirror images of each other. Each wire element 132A and 132B includes upwardly extending flanges 134 at either end, an upwardly bent portion 140 in the middle, and middle portions 136 between the flanges 134 and the bent portion 140.

The wire elements 132A and 132B are connected together with welds 138 or similar or equivalent connection means, as illustrated in FIG. 4, and then the wire elements 132A and 132B are bent into the generally C-shaped cross-section, as illustrated in the FIG. 5. The flanges 134 may be embedded in the concrete of the wall facing element 12, for anchoring the connection bracket 130 in the wall facing element 12. The upwardly bent portions 140 of the wire elements 132A and 132B together form an aperture 142, illustrated in FIG. 4, that is adapted to receive the second interlocking element 46 of the elongate soil reinforcement element 30, as described above.

Figure 6:
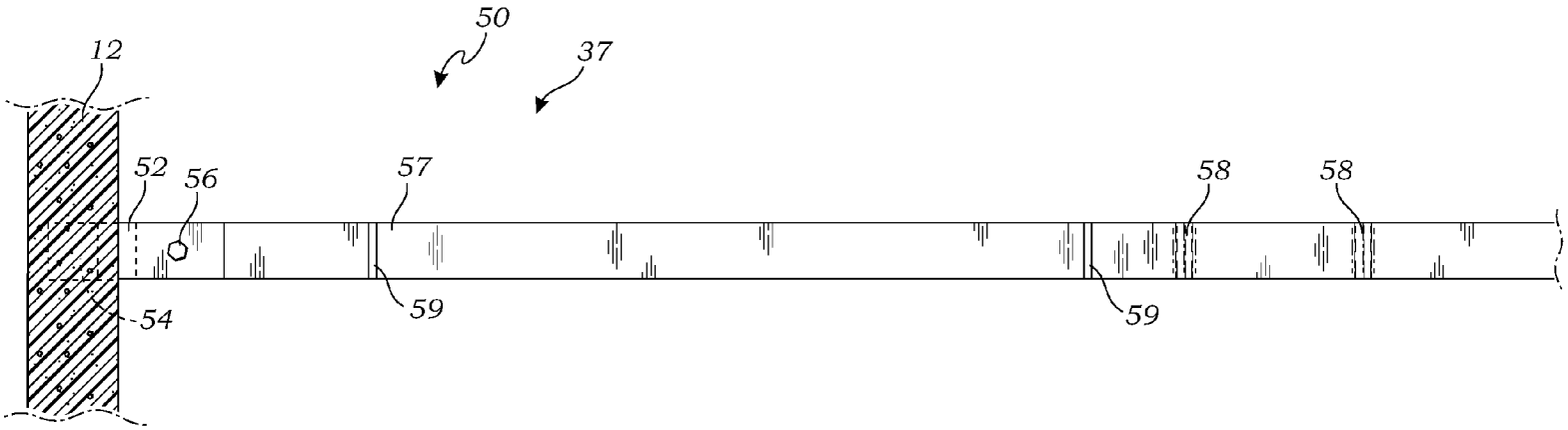
FIG. 6 is a top plan view of a second embodiment of the mechanically stabilized embankment system.
Figure 7:
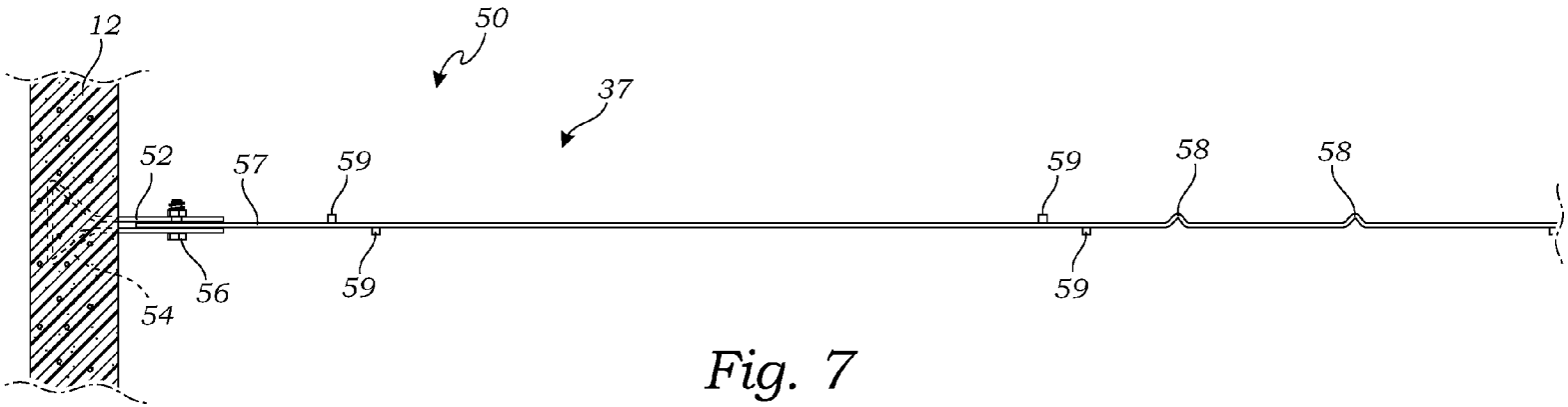
FIG. 7 is a side elevation view thereof.

FIG. 6 is a top plan view of a second embodiment of the mechanically stabilized embankment system 50, and FIG. 7 is a side elevation view thereof. As illustrated in FIGS. 6 and 7, the second embodiment of the mechanically stabilized embankment system 50 includes a connection bracket 52 that includes a loop 54 or similar feature that is adapted to be embedded in the concrete of the wall facing element 12. In the embodiment of FIGS. 6 and 7, the loop 54 has a generally triangular cross-section; however, it may be as any shape or configuration deemed suitable by one skilled in the art. In this embodiment, the soil reinforcement element is formed by a strap 57 that is attached to the connection bracket 52 with a bolt 56 or similar fastener.

As illustrated in FIG. 7, this embodiment of the soil reinforcement element is a strap 57 that is much wider than it is thick. The strap 57 includes V-shaped semi-extensible bent segments 58. The V-shape extends laterally, so that this portion of the strap 57 is semi-extensible and may be pulled straight to absorb strain without breaking.

Also illustrated in FIGS. 6 and 7, the strap 57 may also include ridges 59 or similar structures, which increase the pullout resistance of the strap 57, as discussed above.

Figure 8:
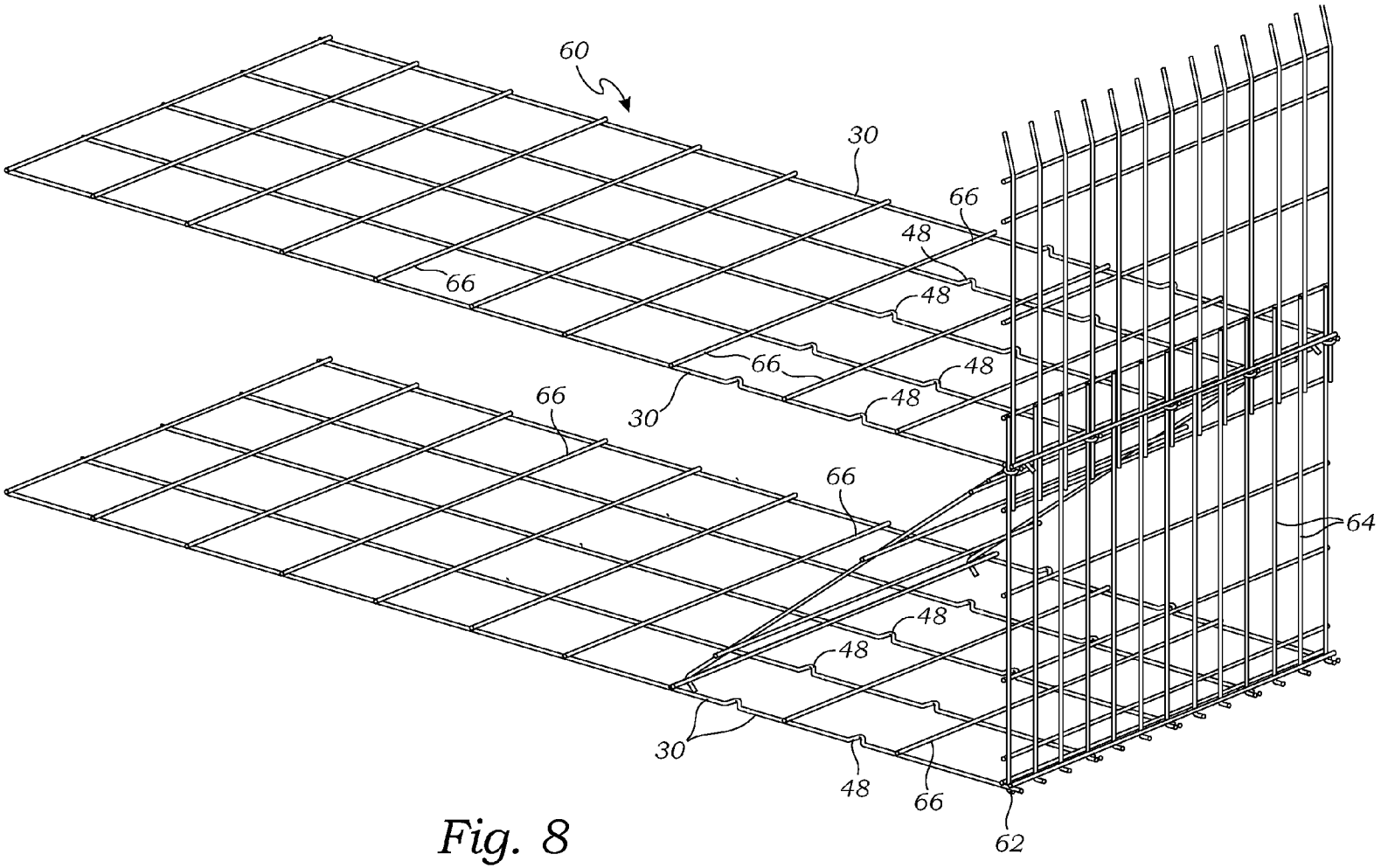
FIG. 8 is a perspective view of a third embodiment of the mechanically stabilized embankment system.

FIG. 8 is a perspective view of a third embodiment of the mechanically stabilized embankment system 60. As illustrated in FIG. 8, in this embodiment the connection bracket is provided by an engagement portion 62 of a wire mesh 64 that provides the wall facing element in this embodiment. The soil reinforcement elements 30 may be attached to each other with a plurality of lateral elements 66 (e.g., rods or other connectors), forming a horizontal mat structure that is adapted to be installed in the earthen embankment.

Figure 9:
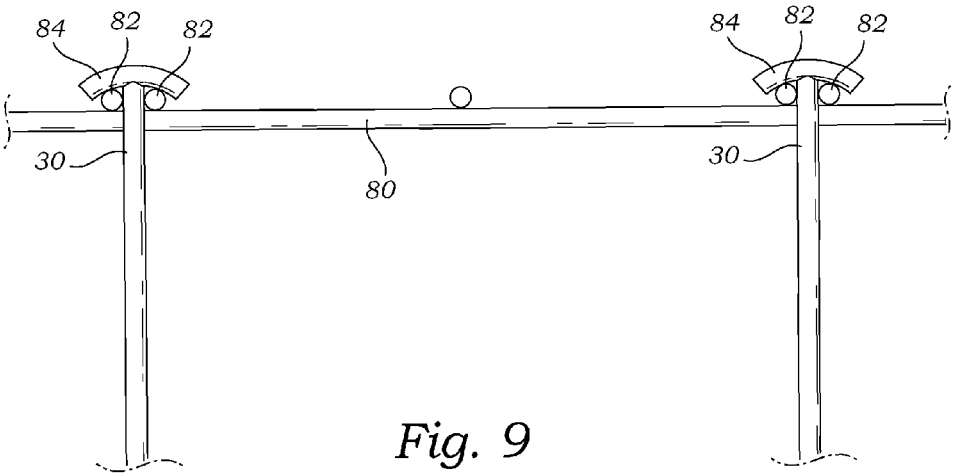
FIG. 9 is a top plan view of a fourth embodiment of the mechanically stabilized embankment system.

FIG. 9 is a top plan view of an alternative embodiment of the means for connecting the soil resistance elements 30 to the wall facing element, in this case a wire mesh 80 similar to the wire mesh 64 illustrated in FIG. 8. In this embodiment, the wire mesh 80 includes vertical supports 82 that are positioned in close proximity to each other, and these vertical supports 82 provide the connection element. The second interlocking element, in this embodiment, is provided by a C-shaped anchor 84 that is welded or otherwise attached to the soil resistance elements 30. The C-shaped anchor 84 may be positioned through the vertical supports 82, turned, and lockingly engage the vertical supports 82. Obviously, the term "C-shaped" is hereby defined to include any functionally similar element that may engage the wire mesh 80 or associated parts in a similar manner.

FIGS. 10A-10D are top plan views of another alternative embodiments of the means for connecting described in FIG. 9. In these embodiments, the connection element is provided by some portion of the wall, or a bracket attached thereto, and the second interlocking element is provided by the proximal portion of the soil reinforcement element 30.

Figure 10A:
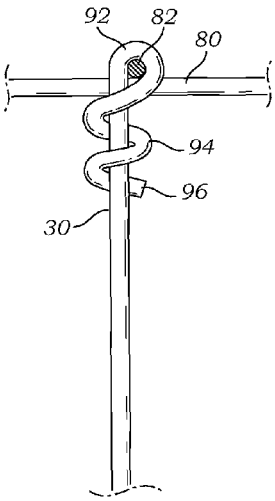
FIG. 10A-10D are top plan views of a fifth embodiment of the system, illustrating different embodiments of the connection between the elongate soil reinforcement element and the wall facing element.

As illustrated in FIG. 10A, in one embodiment the connection element is provided by part of the wire mesh 80, and the second interlocking element is provided by the proximal portion 36 of the soil reinforcement element 30, which includes an integral bent portion 92 for engaging a single vertical support 82 (of the wire mesh 64 of FIG. 8). In the embodiment of FIG. 10A, the integral bent portion 92 may be bent to include a spiral portion 94 that extends to an end 96 that enables the integral bent portion 92 to be easily yet securely attached to the vertical support 82 by twisting the end 96 around the vertical support 82.

Figure 10B:
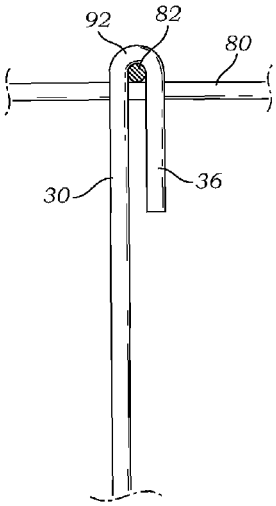

In the embodiment of FIG. 10B, the integral bent portion 92 is 180 degrees and then extends straight adjacent the soil reinforcement element 30. This embodiment relies upon the compacted soil adjacent the bent portion 92 to maintain the bend of the proximal portion 36 around the vertical support 82, so that no twist is required, and the installation is made simpler.

Figure 10C:
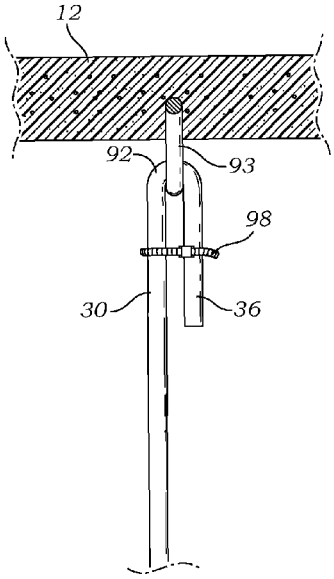
Figure 10D:
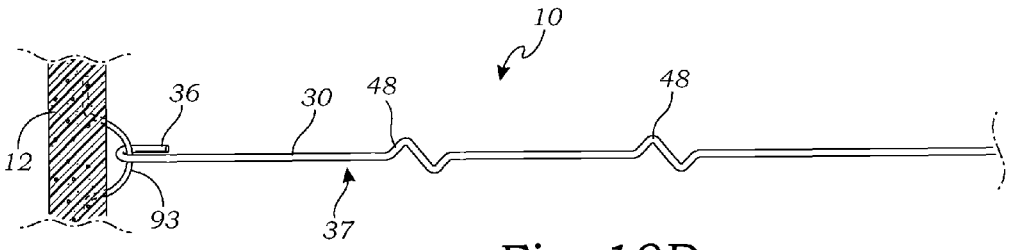

In the embodiment of FIG. 10C, the soil reinforcement element 30 is bent around a wire 93 (e.g. some form of loop, ring, or similar attachment point) that is embedded in the concrete of the wall 12. The proximal portion 36 is bent around the wire 93, as in FIG. 10B, but in this embodiment a zip tie 98 or similar fastener may be used to further fasten the proximal portion 36 in place to prevent unwanted movement. Likewise, FIG. 10D illustrates the proximal portion 36 of the soil reinforcement element 30 being bent around the wire 93.

Figure 11:
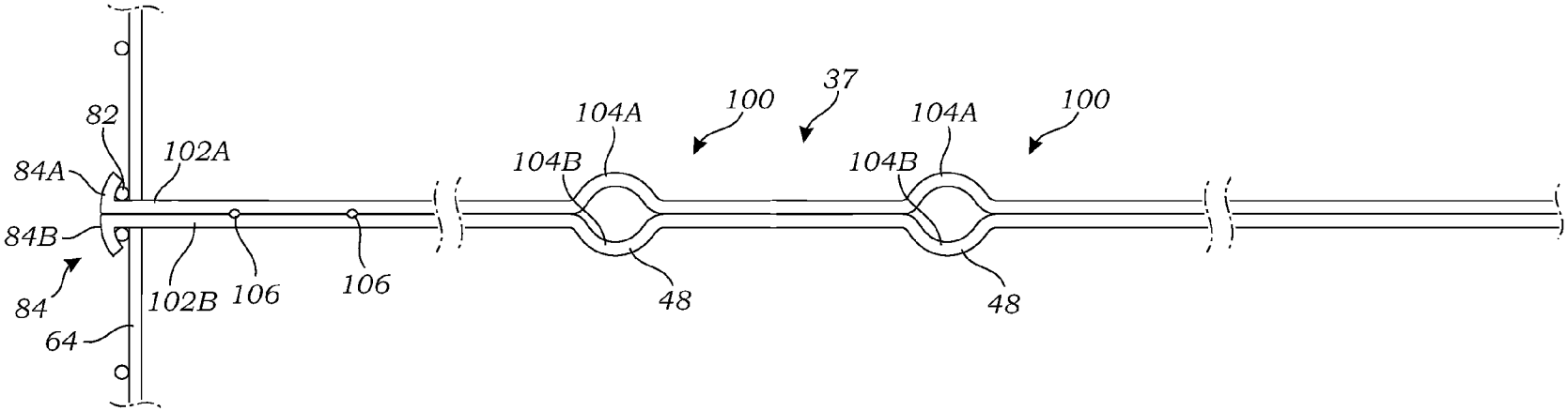
FIG. 11 is a top plan view of a sixth embodiment of the mechanically stabilized embankment system.
Figure 12:
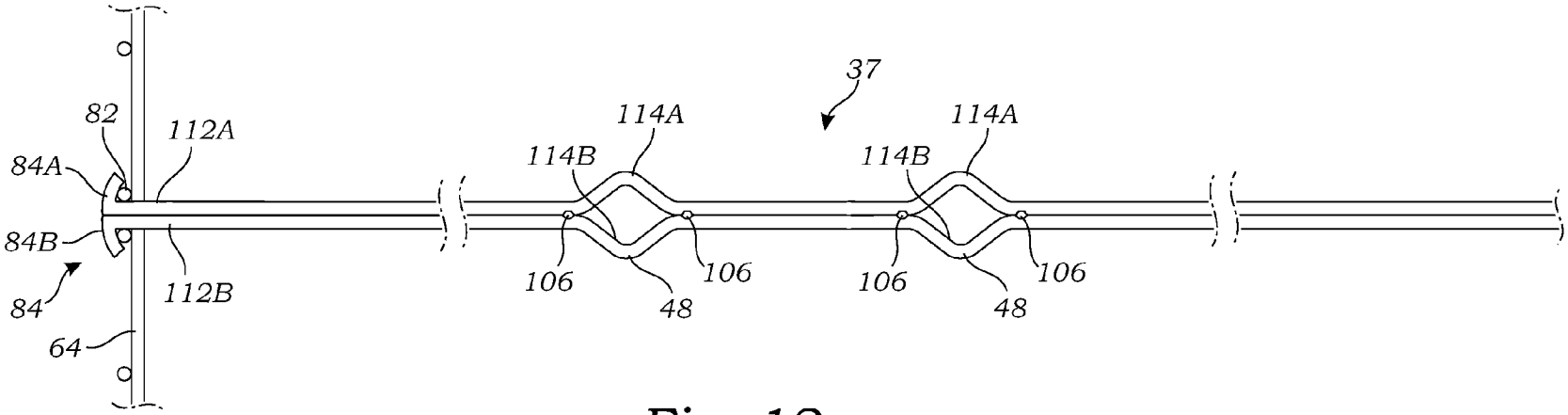
FIG. 12 is a top plan view of a seventh embodiment of the mechanically stabilized embankment system.

FIGS. 11 and 12 are additional alternative embodiments of the elongate soil reinforcement element 30 and the connection element 20, discussed above. In the embodiment of FIG. 11, the alternative embodiment of the elongate soil reinforcement element 100 includes first and second elements 102A and 102B connected together with welds 106 or similar attachment elements or means. This embodiment of the connection element 84 is formed by integral proximal portions 84A and 84B which are formed to engage vertical supports 82. Each of the first and second elements 102A and 102B includes opposing shaped elements 104A and 104B. In the embodiment of FIG. 11, the opposing shaped elements 104A and 104B are curved to form, together, a circle or oval.

In the embodiment of FIG. 12, first and second elements 112A and 112B include opposed shaped elements 114A and 114B that are bent to form, together, a square or rectangle. Those skilled in the art may devise alternative shapes with similar function, and such alternatives should be considered within the scope of the present invention.

Figure 13:
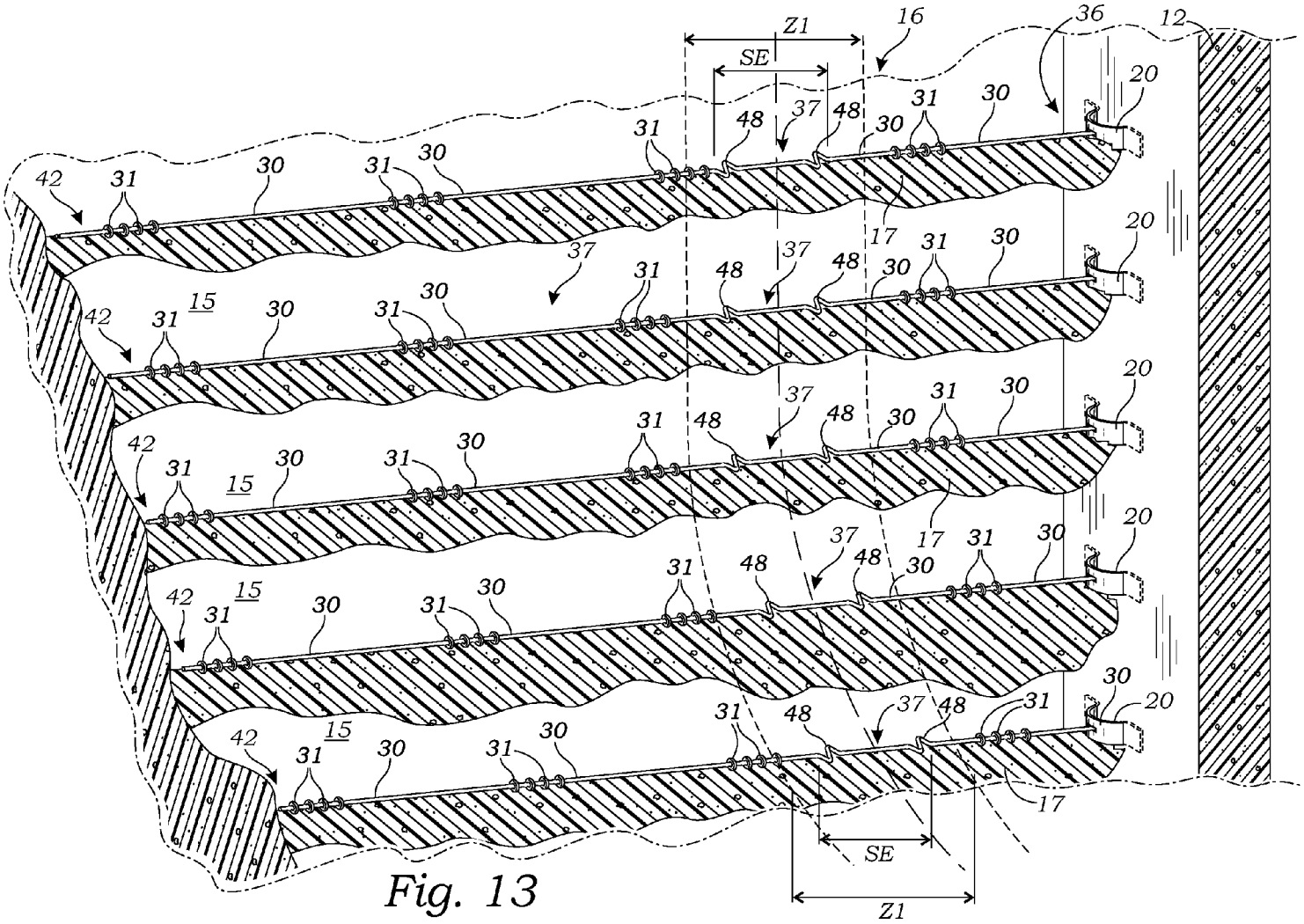
FIG. 13 is a perspective sectional view of an earthen embankment illustrating how the elongate soil reinforcement elements of FIG. 1 are positioned to stabilize the earthen embankment.

FIG. 13 is a perspective sectional view of an earthen embankment 15 illustrating how the earthen embankment 15 is constructed using the elongate soil reinforcement elements 30 of FIG. 1. As illustrated in FIG. 13, the method for constructing the mechanically stabilized earthen embankment 15 in a location 16 comprises the steps of first constructing the wall facing element 12 adjacent the location 16 of the earthen embankment 15.

The elongate soil reinforcement elements 30 are each positioned adjacent the wall facing element 12 such that the elongate soil reinforcement elements 30 extend into the location 16 of the earthen embankment 15. The proximal portions 36 of each of the plurality of elongate soil reinforcement elements 30 are attached to the wall facing element 12. Fill soil 17 is then added to the location 16 to build the earthen embankment 15 over the plurality of elongate soil reinforcement elements 30.

Constructed in this manner, stress in the fill soil 17 will create sufficient force to straighten some of the plurality of semi-extensible bent segments 48 in the middle portions 37 of the plurality of elongate soil reinforcement elements 30, allowing the earthen embankment 15 to move to an active condition thereby reducing the stress on the soil reinforcement elements 30. Once this movement has occurred, the elongate soil reinforcement elements 30 become non-extensible, so further movement, sagging, weakening, etc., can occur. For purposes of this application, the term "earthen embankment" is hereby defined to include any form of earthen formation that is to be stabilized consistent with the present description.

Figure 14:
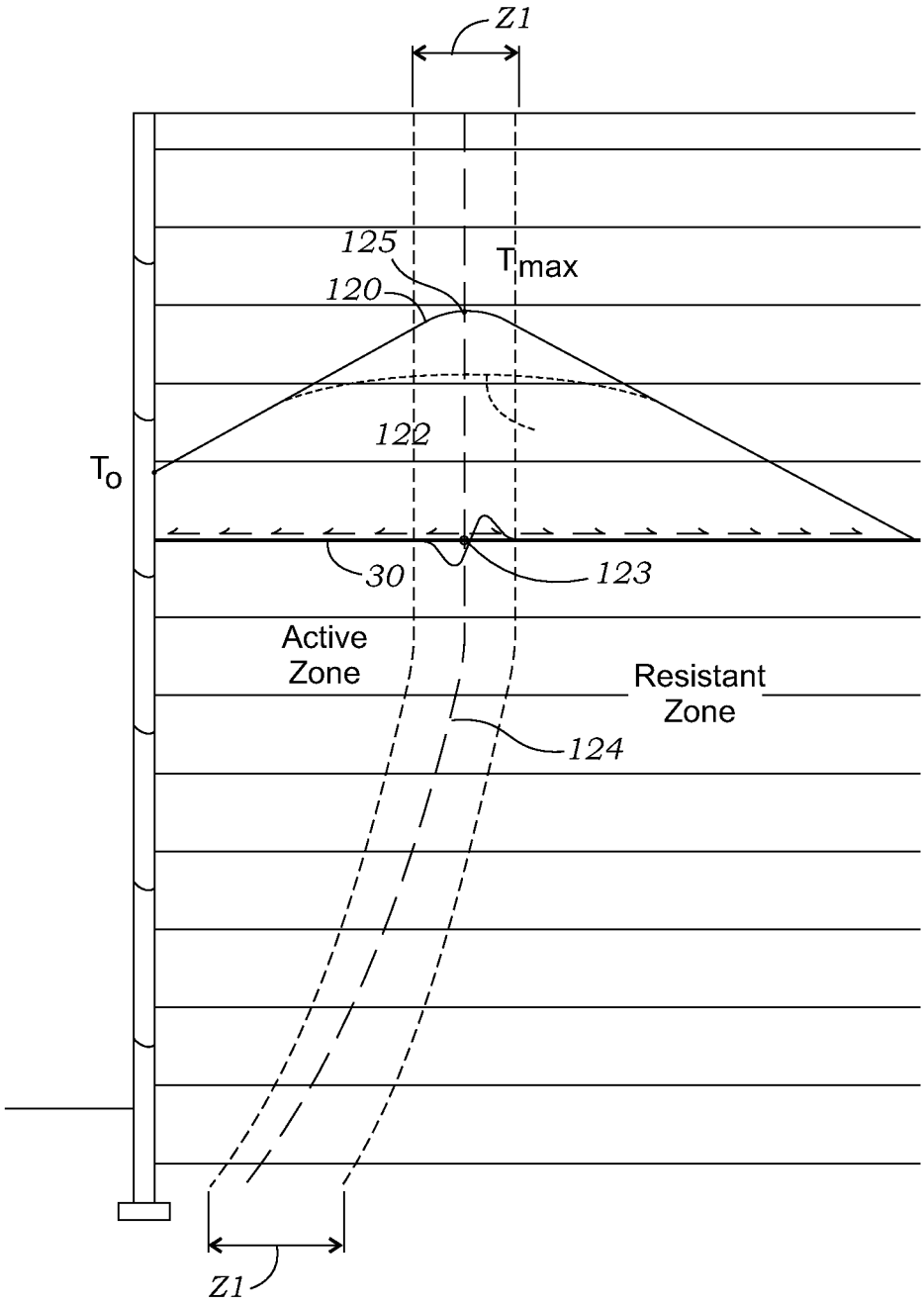
FIG. 14 is a graph illustrating how the plurality of semi-extensible bent segments function to reduce the stress placed on the elongate soil reinforcement element at an intersection point of the elongate soil reinforcement element with the plane of maximum force.

As more fully described in the discussion of FIG. 14, the plurality of elongate soil reinforcement 30 elements are positioned with the proximal ends 33 adjacent the wall facing element 12 such that the elongate soil reinforcement elements 48 extend into the location of the earthen embankment 15 and such that the semi-extensible region SE is within a zone of maximum force Z1.

In one embodiment, the plurality of elongate soil reinforcement elements 30 may each be about 3 m. (10 ft.) long and may have two of the semi-extensible bent segments 48 spaced about 0.61 m. (2 ft.) apart making the semi-extensible region SE about 0.61 m. (2 ft.) long.

In another embodiment, the plurality of elongate soil reinforcement elements 30 may each be between about 4.6-6.1 m. (15-20 ft.) long and may have three of the semi-extensible bent segments 48 spaced about 0.61 m. (2 ft.) apart making the semi-extensible region SE about 1.2 m. (4 ft.) long.

FIG. 14 is a graph illustrating how the plurality of semi-extensible bent segments 48 (illustrated in FIG. 13) function to reduce the stress placed on the elongate soil reinforcement element 30 at an intersection point 123 of the elongate soil reinforcement element 30 with a plane of maximum force 124. In a first instance 120, prior art systems result in a peak force 125 at the intersection point 123 of the elongate soil reinforcement element 30 with the plane of maximum force 124. As the soil pulls on the elongate soil reinforcement element 30 in either direction, a maximum tensile force $T_{MAX}$ is created in the rod (at the intersection point 123), which falls to zero at the end furthest from the wall facing element 12, and to a surface value of $T_0$ at the wall facing element 12.

There is also the zone of maximum force Z1, which includes the plane of maximum force 124. In one embodiment, the zone of maximum force Z1 extends on either side of the plane of maximum force 124 a total depth that is between 5-35% of the length of the plurality of elongate soil reinforcement elements 30. In another embodiment, the zone of maximum force Z1 is defined to extend in both directions along the elongate soil reinforcement element 30 a distance no greater than 20% of the total length of the elongate soil reinforcement element 30. In yet another embodiment, the zone of maximum force Z1 is defined to extend perpendicularly to the plane of maximum force 124, on one side, a distance of 20% of the distance between the plane of maximum force 124 and the proximal end 33 (shown in FIG. 1), and on the other side, a distance of 20% of the distance between the plane of maximum force 124, and the distal end 34 (shown in FIG. 1).

As shown in FIGS. 13 and 14, the semi-extensible region SE is located such that at least part of the semi-extensible region SE overlaps with the zone of maximum force Z1. As shown in FIG. 14, the plane of maximum force 124 typically moves closer to the base of the wall facing element 12 due to the pressure of the earth as the depth increases. Regardless of the location of the plane of maximum force 124, the semi-extensible region SE remains localized to the area in and about the zone of maximum force Z1 and does not extend arbitrarily throughout the length of the elongate soil reinforcement element 30.

The elongate soil reinforcement element 30 must be constructed of steel (or other suitable material) that is strong enough to withstand this peak force 125. As the elongate soil reinforcement elements 30 deform and extend, this has the effect of reducing the force in and about the semi-extensible region SE. This is shown by the dashed line indicating a second instance 122, where the tension profile has been flattened by the action in the semi-extensible region SE. This enables the backfill of the earthen embankment to go into "active" condition, and resist movement, thereby reducing the strain on the soil reinforcement elements. This reduced strain enables the use of soil reinforcement elements 30 that are lighter and require less steel.

Figure 15A:
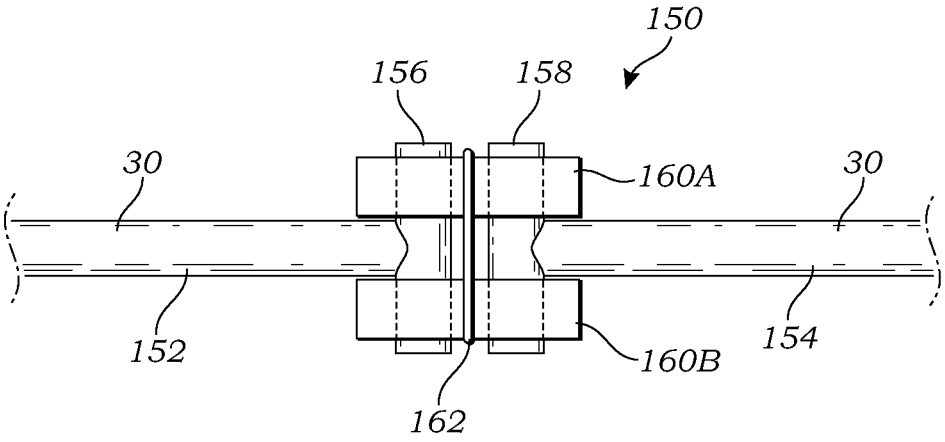
FIG. 15A is a side elevational view of a splicing element for splicing two different segments of the elongate soil reinforcement element.
Figure 15B:
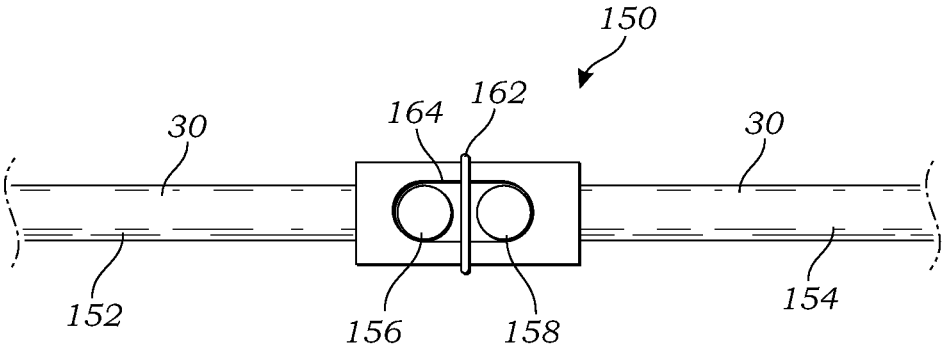
FIG. 15B is a top plan view thereof.

FIG. 15A is a side elevational view of a splicing element 150 for splicing two different segments 152 and 154 of the elongate soil reinforcement element 30, and FIG. 15B is a top plan view thereof. As illustrated in FIGS. 15A and 15B, it is sometimes necessary to splice the two different segments 152 and 154 of the elongate soil reinforcement element 30. In this embodiment, the splicing element 150 is formed by T-sections 156 and 158 (or similar structures) of the two different segments 152 and 154, respectively, and a pair of locking elements 160A and 160B. The locking elements 160A and 160B are, for example, steel plates that include one or more locking apertures 164 for engaging the T-sections 156 and 158. A temporary fastener 162 such as a tie wire holds the locking elements 160A and 160B in place until the soil is added to cover the splicing element 150, after which the soil maintains the locking elements 160A and 160B in place.

Figure 16:
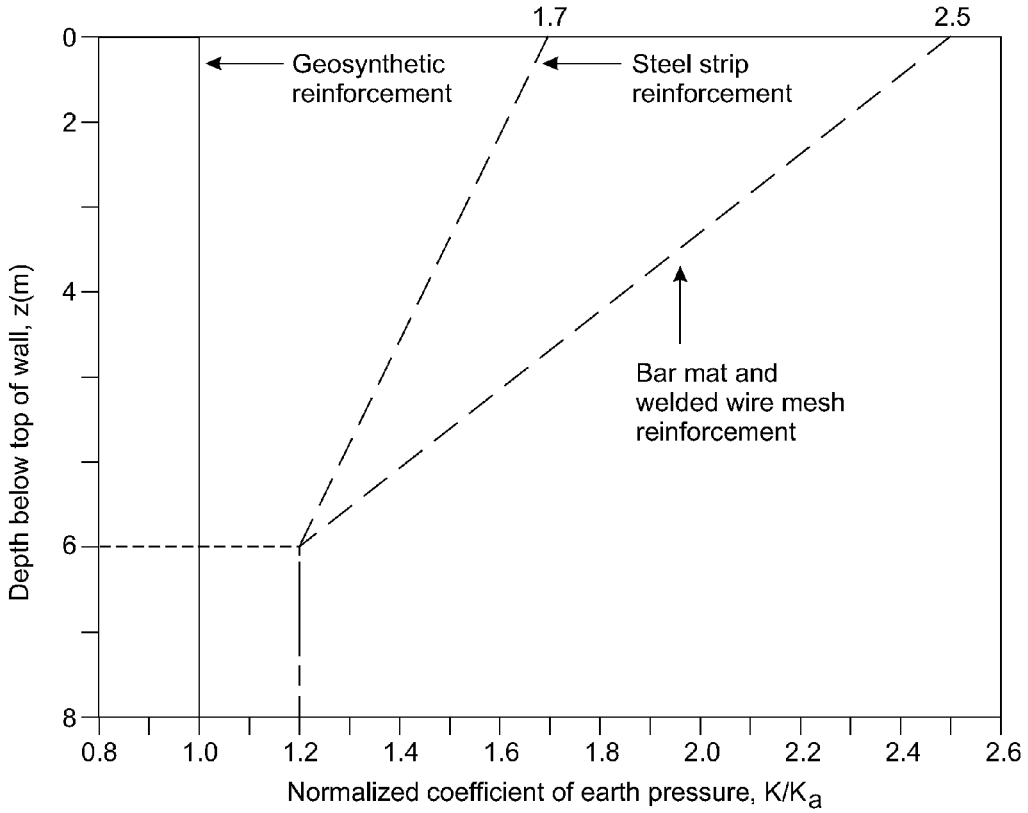
FIG. 16 is a graph illustrating a normalized coefficient of earth pressure relative to a depth below the top of the wall.

FIG. 16 is a graph illustrating a normalized coefficient of earth pressure relative to a depth below the top of the wall. As illustrated in FIG. 16, extensible geosynthetic reinforcements (such as plastic reinforcements) retain a K/Ka value of 1, while steel reinforcements require from 1.2-2.5 K/Ka. The utilization of semi-extensible reinforcement elements 30 should enable a steel product that has a K/Ka value of 1, without the disadvantages of the plastic products, described above.

The semi-extensible nature of the reinforcements utilized in the present application will result in the ability to utilize much less steel in the construction of the reinforcing elements 30, and thereby reduce the costs of the embankment system 10, without the disadvantages of other prior art systems that are fully extensible.

Figure 17:
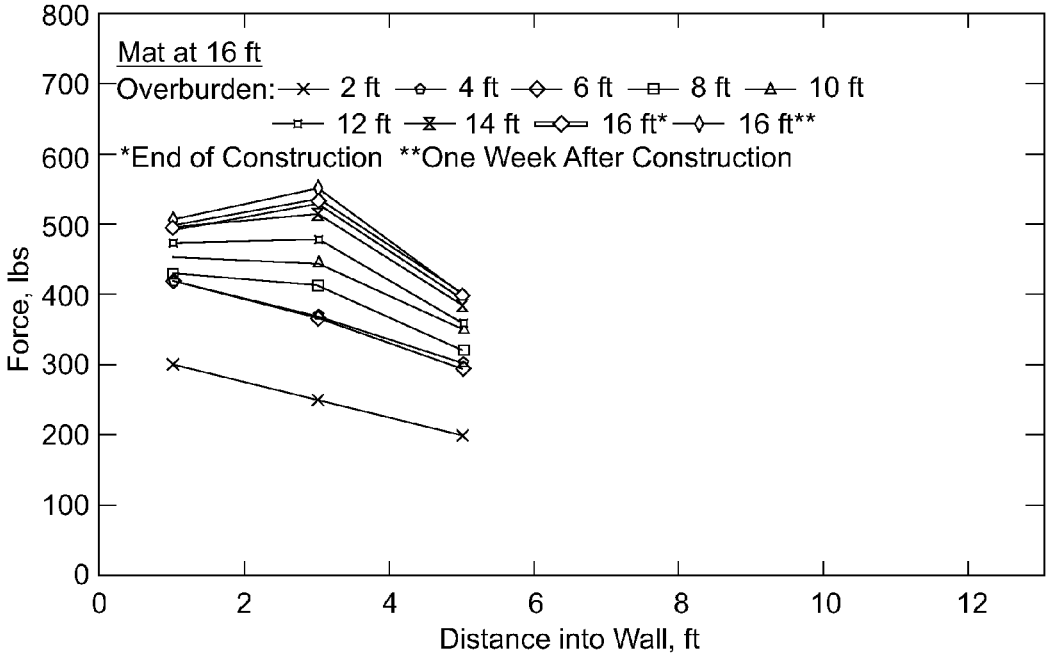
FIG. 17 is a graph illustrating the tensile force along the elongate soil reinforcement element without the semi-extensible bent segments.
Figure 18:
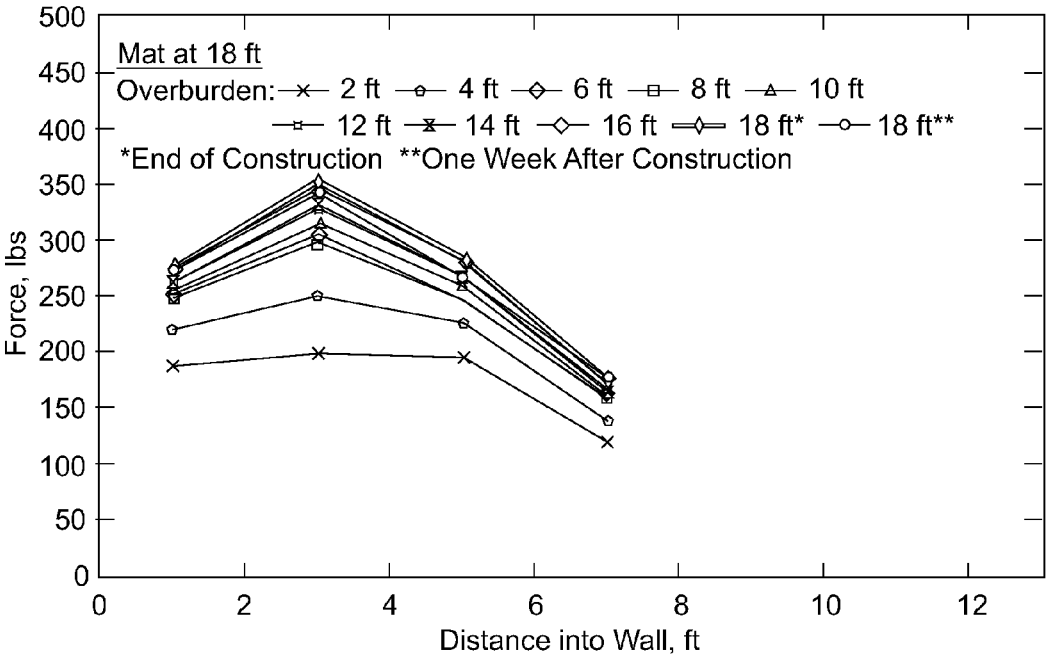
FIG. 18 is a graph illustrating the reduced tensile force along the elongate soil reinforcement element with the semi-extensible bent segments.

FIG. 17 is a graph illustrating the tensile force along the elongate soil reinforcement element 30 (shown in FIG. 1) without the semi-extensible bent segments 48 (shown in FIG. 1). FIG. 18 is a graph illustrating the reduced tensile force along the elongate soil reinforcement element 30 with the semi-extensible bent segments 48.

FIG. 17 shows a family of curves plotting the tensile force along the elongate soil reinforcement element 30 at differing vertical depths, or overburdens. "Overburden" is defined to mean the amount of soil or other material above an object or region of interest, in this case, the amount of fill above a given elongate soil reinforcement element 30. As expected, the tensile force increases with increasing overburden. Also, at a distance from the wall facing element 12 (wall) of about three feet, a zone of maximum force Z1 (as in FIGS. 13-14) becomes apparent.

FIG. 18 is very similar to FIG. 17, however shows a marked reduction in the amount of tensile force, due to the semi-extensible bent segments 48, under similar conditions. Here, the semi-extensible bent segments 48 have previously deformed to relax the tension in the elongate soil reinforcement rod 30. Comparing the maximum values of the tensile force at an overburden of 4.87 m (16 ft.), we see that without the semi-extensible bent segments 48 the tensile force is approximately 2446 N (550 lbs.), whereas with the semi-extensible bent segments 48 the tensile force is approximately 1556 N (350 lbs.). The above figures quantitatively demonstrate the merits of placing the semi-extensible bent segments 48 near the zone of maximum force Z1.

The above described elements allow a method for constructing a mechanically stabilized earthen embankment in a location by first positioning the plurality of the elongate soil reinforcement elements 30 with the proximal ends 33 adjacent the wall facing element 12 such that the elongate soil reinforcement elements 30 extend into the location of the earthen embankment 15 and such that the semi-extensible region SE is within the zone of maximum force Z1. Connecting the proximal end 33 of each of the plurality of elongate soil reinforcement elements 30 to the wall facing element 12. Adding fill soil 17 to the location to build the earthen embankment 15 over the plurality of elongate soil reinforcement elements 30. Repeating the steps of positioning more of the plurality of elongate soil reinforcement elements 30, connecting them to the wall facing elements 12, and adding fill soil 17, until the mechanically stabilized earthen embankment 15 has been completed, and such that stress in the fill soil 17 creates sufficient force to straighten some of the plurality of semi-extensible bent segments 48, allowing the earthen embankment 15 to move to an active condition thereby reducing the stress on the soil reinforcement elements 30.

As used in this application, the words "a," "an," and "one" are defined to include one or more of the referenced item unless specifically stated otherwise. Also, the terms "have," "include," "contain," and similar terms are defined to mean "comprising" unless specifically stated otherwise. Furthermore, the terminology used in the specification provided above is hereby defined to include similar and/or equivalent terms, and/or alternative embodiments that would be considered obvious to one skilled in the art given the teachings of the present patent application. While some representative embodiments of the anchor system 10 are illustrated herein, the scope of the present invention should not be limited to these embodiments, but should include any alternative embodiments, constructions, and/or equivalent embodiments that might be devised by those skilled in the art.

What is claimed is:

1. A method for constructing a mechanically stabilized earthen embankment in a location, the method comprising the steps of:

constructing a wall facing element adjacent the location of the earthen embankment;

providing a plurality of elongate soil reinforcement elements, each having a proximal end, a distal end, and a length;

determining a plane of maximum force that will be generated by the mechanically stabilized earthen embankment once it has been constructed in the location;

defining a zone of maximum force that includes the plane of maximum force and extends on either side of the plane of maximum force a total depth that is between 5-35% of the length of the plurality of elongate soil reinforcement elements;

forming in each of the elongate soil reinforcement elements two or more semi-extensible bent segments, the semi-extensible bent segments forming a semi-extensible region, but wherein a proximal portion of the elongate soil reinforcing elements adjacent the proximal end, and a distal portion adjacent the distal end, remain substantially straight and inextensible;

positioning the plurality of elongate soil reinforcement elements with the proximal ends adjacent the wall facing element such that the elongate soil reinforcement elements extend into the location of the earthen embankment and such that the semi-extensible region is within the zone of maximum force;

connecting the proximal end of each of the plurality of elongate soil reinforcement elements to the wall facing element;

adding fill soil to the location to build the earthen embankment over the plurality of elongate soil reinforcement elements;

repeating the steps of positioning more of the plurality of elongate soil reinforcement elements, connecting them to the wall facing elements, and adding fill soil, until the mechanically stabilized earthen embankment has been completed, and such that stress in the fill soil creates sufficient force to straighten some of the plurality of semi-extensible bent segments, allowing the earthen embankment to move to an active condition thereby reducing the stress on the soil reinforcement elements.

2. The method of claim 1, wherein the zone of maximum force is defined to extend in both directions along the elongate soil reinforcement element a distance no greater than 20% of the total length of the elongate soil reinforcement element.

3. The method of claim 1, wherein the proximal portion of the elongate soil reinforcement element extends at least 3.0 feet from the proximal end of the elongate soil reinforcement element.

4. The method of claim 1, wherein the distal portion of the elongate soil reinforcement element extends at least 3.0 feet from the distal end of the elongate soil reinforcement element.

5. The method of claim 1, wherein the zone of maximum force is defined to extend perpendicularly to the plane of maximum force, on one side, a distance of 20% of the distance between the plane of maximum force and the proximal end, and on the other side, a distance of the distance between the plane of maximum force, and the distal end.

6. The method of claim 1, wherein the elongate soil reinforcement elements are each 12 ft. or more in length, wherein the proximal portion of the elongate soil reinforcement element extends at least 5.0 feet from the proximal end of the elongate soil reinforcement element, and wherein the distal portion of the elongate soil reinforcement element extends at least 5.0 feet from the distal end of the elongate soil reinforcement element, such that the proximal portion and the distal portion are substantially straight and inextensible and do not include any semi-extensible bent segments.

7. The method of claim 1, wherein the bent segments of the elongate soil reinforcement elements are disposed on a horizontal plane when connected to the wall facing element.

8. The method of claim 1, wherein the plurality of elongate soil reinforcement elements are each about 10-12 ft. long and have two of the semi-extensible bent segments spaced about 2 ft. apart.

9. The method of claim 1, wherein the plurality of elongate soil reinforcement elements are each between about 15-20 ft. long and have 2-3 of the semi-extensible bent segments each spaced about 2 ft. apart.

* * * * *